US008992043B2

(12) United States Patent
Marquardt et al.

(10) Patent No.: US 8,992,043 B2
(45) Date of Patent: Mar. 31, 2015

(54) CONSTRUCTIVE OCCLUSION LIGHTING SYSTEM AND APPLICATIONS THEREOF

(75) Inventors: Craig Eugene Marquardt, Covington, GA (US); Heather Waugh, Louisville, CO (US); Xin Zhang, Atlanta, GA (US)

(73) Assignee: ABL IP Holding LLC, Conyers, GA (US)

( * ) Notice: Subject to any disclaimer, the term of this patent is extended or adjusted under 35 U.S.C. 154(b) by 279 days.

(21) Appl. No.: 13/579,164

(22) PCT Filed: Feb. 15, 2011

(86) PCT No.: PCT/US2011/024922

§ 371 (c)(1),
(2), (4) Date: Aug. 15, 2012

(87) PCT Pub. No.: WO2011/100756

PCT Pub. Date: Aug. 18, 2011

(65) Prior Publication Data

US 2012/0314413 A1 Dec. 13, 2012

Related U.S. Application Data

(60) Provisional application No. 61/304,761, filed on Feb. 15, 2010.

(51) Int. Cl.
*F21V 13/02* (2006.01)
*F21V 7/00* (2006.01)
(Continued)

(52) U.S. Cl.
CPC ..... *F21V 7/0058* (2013.01); *F21Y 2101/02* (2013.01); *F21Y 2103/022* (2013.01)
USPC ..... 362/235

(58) Field of Classification Search
CPC ..... F21V 7/0058
USPC ..... 362/235, 147, 247, 296.01
See application file for complete search history.

(56) References Cited

U.S. PATENT DOCUMENTS

D47,642 S 7/1915 Dixon
D103,428 S 3/1937 Guth
(Continued)

FOREIGN PATENT DOCUMENTS

WO WO9727449 7/1997
WO WO9920937 4/1999
(Continued)

OTHER PUBLICATIONS

International Search Report and Written Opinion for PCT/US2011/24922, mailed Apr. 6, 2011 (13 pages).
(Continued)

*Primary Examiner* — David V Bruce
(74) *Attorney, Agent, or Firm* — Kilpatrick, Townsend & Stockton, LLP

(57) ABSTRACT

A luminaire includes at least one light source, at least one reflector having a reflector cavity and an optical element positioned to receive light reflected from the at least one reflector cavity. The luminaire does not include a mask or other structure located within the opening of the luminaire that would partially occlude light exiting the luminaire—light can thus exit the luminaire unimpeded. In some embodiments, the at least one reflector cavity is semi toroidal. Moreover, in some embodiments, the optical element includes a reflective optical element, a refractive optical element or a combination thereof. Methods of lighting a surface are also described.

17 Claims, 10 Drawing Sheets

(51) Int. Cl.
*F21Y 101/02* (2006.01)
*F21Y 103/02* (2006.01)

(56) References Cited

U.S. PATENT DOCUMENTS

| | | | |
|---|---|---|---|
| D115,971 | S | 8/1939 | Stewart |
| 2,329,557 | A | 9/1943 | Rolph |
| D262,914 | S | 2/1982 | Kristofek |
| D297,717 | S | 9/1988 | Chu |
| D350,409 | S | 9/1994 | Johnson et al. |
| D389,597 | S | 1/1998 | Gismondi |
| 5,705,804 | A | 1/1998 | Ramer et al. |
| 5,733,028 | A | 3/1998 | Ramer et al. |
| 5,773,819 | A | 6/1998 | Ramer et al. |
| D400,170 | S | 10/1998 | Asai et al. |
| 5,877,490 | A | 3/1999 | Ramer et al. |
| 5,877,849 | A | 3/1999 | Ramer et al. |
| 5,886,351 | A | 3/1999 | Ramer et al. |
| 5,914,487 | A | 6/1999 | Ramer et al. |
| 5,967,652 | A | 10/1999 | Ramer et al. |
| 6,007,225 | A | 12/1999 | Ramer et al. |
| 6,043,873 | A | 3/2000 | Ramer et al. |
| 6,045,238 | A | 4/2000 | Wheeler et al. |
| 6,064,061 | A | 5/2000 | Ramer et al. |
| 6,088,091 | A | 7/2000 | Ramer et al. |
| 6,238,077 | B1 | 5/2001 | Ramer et al. |
| 6,266,136 | B1 | 7/2001 | Ramer et al. |
| 6,273,338 | B1 | 8/2001 | White |
| 6,286,979 | B1 | 9/2001 | Ramer et al. |
| 6,334,700 | B2 | 1/2002 | Ramer et al. |
| 6,342,695 | B1 | 1/2002 | Ramer et al. |
| 6,447,145 | B1 | 9/2002 | Thomas et al. |
| D468,051 | S | 12/2002 | Gaskins et al. |
| 6,543,911 | B1 | 4/2003 | Rizkin et al. |
| 6,700,112 | B2 | 3/2004 | Brown |
| D508,062 | S | 8/2005 | Rashidi |
| D509,007 | S | 8/2005 | Shimada |
| 6,974,498 | B2 | 12/2005 | Brown |
| 6,988,815 | B1 | 1/2006 | Rizkin et al. |
| 6,995,355 | B2 | 2/2006 | Rains, Jr. et al. |
| 7,012,382 | B2 | 3/2006 | Cheang et al. |
| D520,143 | S | 5/2006 | Yoneda |
| 7,121,690 | B1 | 10/2006 | Ramer et al. |
| 7,144,131 | B2 | 12/2006 | Rains |
| 7,145,125 | B2 | 12/2006 | May et al. |
| 7,148,470 | B2 | 12/2006 | Rains, Jr. et al. |
| 7,157,694 | B2 | 1/2007 | May et al. |
| D541,975 | S | 5/2007 | Isaacson et al. |
| 7,347,590 | B2 | 3/2008 | Lee et al. |
| 7,365,991 | B2 | 4/2008 | Aldrich et al. |
| D568,830 | S | 5/2008 | Park et al. |
| 7,374,311 | B2 | 5/2008 | Rains, Jr. et al. |
| D574,551 | S | 8/2008 | Park |
| D588,300 | S | 3/2009 | Sabernig |
| 7,513,656 | B2 | 4/2009 | Park et al. |
| 7,521,667 | B2 | 4/2009 | Rains, Jr. et al. |
| 7,554,742 | B2 | 6/2009 | Chinniah et al. |
| D619,754 | S | 7/2010 | Lai et al. |
| D619,755 | S | 7/2010 | Lai et al. |
| D619,756 | S | 7/2010 | Lai et al. |
| D623,610 | S | 9/2010 | Mallory et al. |
| D624,948 | S | 10/2010 | Lai et al. |
| D626,523 | S | 11/2010 | Mallory et al. |
| 7,828,459 | B2 | 11/2010 | Rains |
| D628,737 | S | 12/2010 | Van den Akker |
| D632,834 | S | 2/2011 | Kon |
| 7,980,728 | B2 | 7/2011 | Ramer et al. |
| 8,021,008 | B2 | 9/2011 | Ramer |
| D654,617 | S | 2/2012 | Marquardt et al. |
| 8,425,101 | B2 | 4/2013 | Boonekamp |
| 2001/0051413 | A1 | 12/2001 | Chantre et al. |
| 2003/0063474 | A1 | 4/2003 | Coushaine |
| 2003/0227774 | A1 | 12/2003 | Martin et al. |
| 2004/0037088 | A1* | 2/2004 | English et al. ..... 362/545 |
| 2005/0024744 | A1 | 2/2005 | Falicoff et al. |
| 2005/0263785 | A1 | 12/2005 | Kim et al. |
| 2006/0067079 | A1 | 3/2006 | Noh et al. |
| 2006/0203483 | A1 | 9/2006 | Rains, Jr. et al. |
| 2006/0237636 | A1 | 10/2006 | Lyons et al. |
| 2006/0268544 | A1 | 11/2006 | Rains, Jr. et al. |
| 2007/0045523 | A1 | 3/2007 | May et al. |
| 2007/0051883 | A1 | 3/2007 | Rains, Jr. et al. |
| 2007/0070530 | A1 | 3/2007 | Seo et al. |
| 2007/0138978 | A1 | 6/2007 | Rains, Jr. et al. |
| 2007/0171649 | A1 | 7/2007 | Rains, Jr. et al. |
| 2007/0235639 | A1 | 10/2007 | Rains, Jr. |
| 2007/0263393 | A1 | 11/2007 | Van de Ven |
| 2008/0005944 | A1 | 1/2008 | Rains, Jr. et al. |
| 2008/0103714 | A1 | 5/2008 | Aldrich et al. |
| 2008/0174690 | A1 | 7/2008 | Chang |
| 2008/0205053 | A1 | 8/2008 | Rains, Jr. et al. |
| 2008/0224025 | A1 | 9/2008 | Lyons et al. |
| 2008/0225520 | A1 | 9/2008 | Garbus |
| 2008/0228508 | A1 | 9/2008 | Lyons et al. |
| 2008/0247170 | A1 | 10/2008 | Peck et al. |
| 2008/0297918 | A1 | 12/2008 | Park et al. |
| 2009/0129097 | A1 | 5/2009 | Ewert et al. |

FOREIGN PATENT DOCUMENTS

| | | |
|---|---|---|
| WO | WO2005106408 | 11/2005 |
| WO | WO2005106963 | 11/2005 |
| WO | WO2006039017 | 4/2006 |
| WO | WO2008113009 | 9/2008 |

OTHER PUBLICATIONS

International Preliminary Report on Patentability for PCT/US2011/24922, mailed Aug. 21, 2012 (7 pages).
Office Action for U.S. Appl. No. 29/385,512 , mailed May 12, 2011 (8 pages).
Amendment and Response to Office Action for U.S. Appl. No. 29/385,512, filed Sep. 12, 2011 (8 pages).

* cited by examiner

CONSTRUCTIVE OCCLUSION LIGHTING SYSTEM AND APPLICATIONS THEREOF

FIELD OF THE INVENTION

The present invention relates to lighting systems and, in particular, to lighting systems employing constructive occlusion.

BACKGROUND OF THE INVENTION

Constructive occlusion techniques have been developed to provide tailored light intensity distributions from luminaires, including low intensity illumination in regions not covered by direct illumination. Current luminaire systems utilize a mask and cavity structure to achieve constructive occlusion. Radiant energy from one or more light sources, for example, reflects and diffuses within the volume between the mask and the cavity. The mask constructively occludes the aperture of the cavity, and the reflected light emerging from between the mask and the cavity provides a desired illumination.

However, using a mask to occlude the aperture of the cavity results in losses in lighting efficiency from the luminaire.

SUMMARY OF EMBODIMENTS OF THE INVENTION

In view of the efficiency disadvantages of current constructive occlusion luminaires, the present invention, in some embodiments, provides luminaires having constructive occlusion light distributions while demonstrating increased lighting efficiencies.

In some embodiments, a luminaire described herein comprises at least one light source, at least one reflector cavity and an optical element positioned to receive light reflected from the at least one reflector cavity, wherein the luminaire does not comprise a mask at least partially occluding the aperture of the at least one reflector cavity. In some embodiments, the at least one reflector cavity is semi toroidal. Moreover, in some embodiments, the optical element comprises a reflective optical element, a refractive optical element or a combination thereof.

In another aspect, the present invention provides methods of lighting a surface. In some embodiments, a method of lighting a surface comprises providing a luminaire comprising at least one light source, at least one reflector cavity and an optical element positioned to receive light reflected from the at least one reflector cavity, wherein the luminaire does not comprise a mask at least partially occluding the aperture of the at least one reflector cavity, reflecting light from the light source off the at least one reflector cavity to the optical element and reflecting or refracting the light received from the at least one reflector cavity out of the luminaire with the optical element.

These and other embodiments are discussed in greater detail in the detailed description which follows.

DETAILED DESCRIPTION OF EMBODIMENTS OF THE INVENTION

The present invention can be understood more readily by reference to the following detailed description and drawings and their previous and following descriptions. Elements, apparatus and methods of the present invention, however, are not limited to the specific embodiments presented in the detailed description and drawings. It should be recognized that these embodiments are merely illustrative of the principles of the present invention. Numerous modifications and adaptations will be readily apparent to those of skill in the art without departing from the spirit and scope of the invention.

As described herein, the present invention, in some embodiments, provides luminaires having constructive occlusion light distributions without employing the traditional architectures used to achieve such distributions. As a result, luminaires described herein can demonstrate enhanced lighting efficiencies in comparison to prior luminaires utilizing constructive occlusion architectures.

In some embodiments a luminaire described herein comprises at least one light source, at least one reflector cavity and an optical element positioned to receive light reflected from the at least one reflector cavity, wherein the luminaire does not comprise a mask at least partially occluding the aperture of the at least one reflector cavity. Because the luminaire does not include a mask, the light can exit the luminaire unimpeded—in other words, light exiting the luminaire is not blocked (or masked) by any structure located within the opening of the luminaire.

Figure 1:
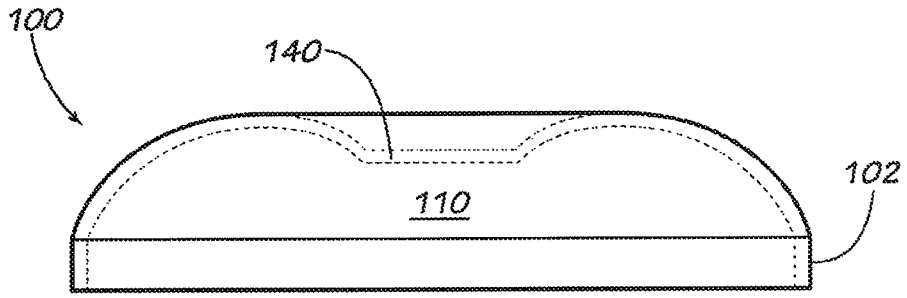
FIG. 1 is a side elevation view of a reflector according to an embodiment of the present invention.
Figure 2:
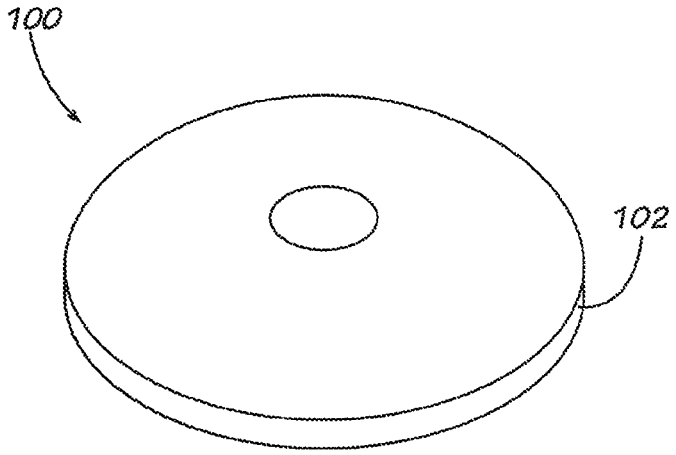
FIG. 2 is a top perspective view of a reflector according to the embodiment of FIG. 1.
Figure 3:
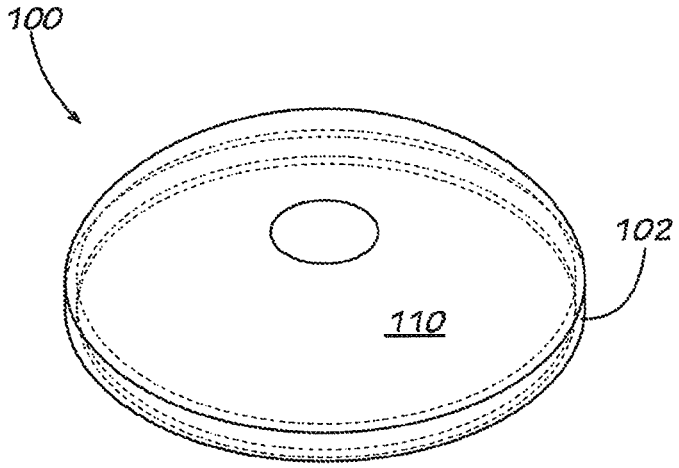
FIG. 3 is another top perspective view of a reflector according to the embodiment of FIG. 1 wherein inner edges are shown with dotted lines.
Figure 4:
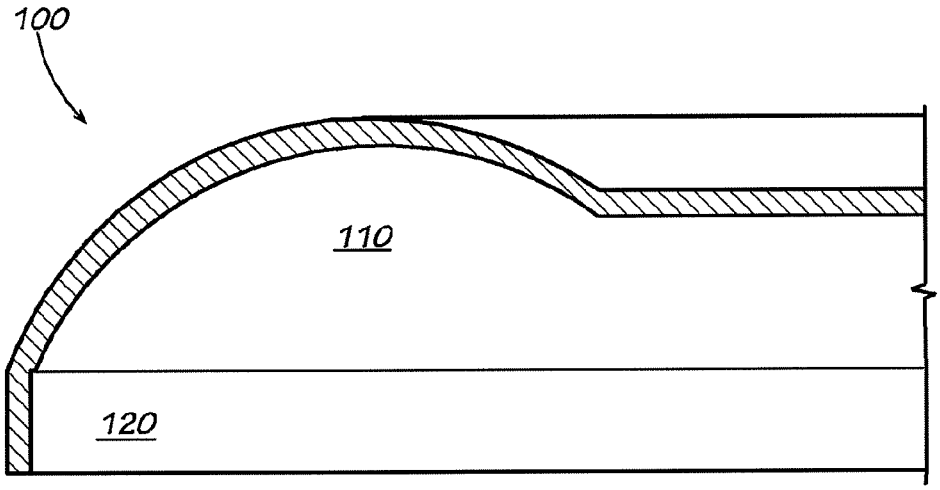
FIG. 4 is a partial cross-sectional view of a reflector according to the embodiment of FIG. 1.
Figure 5:
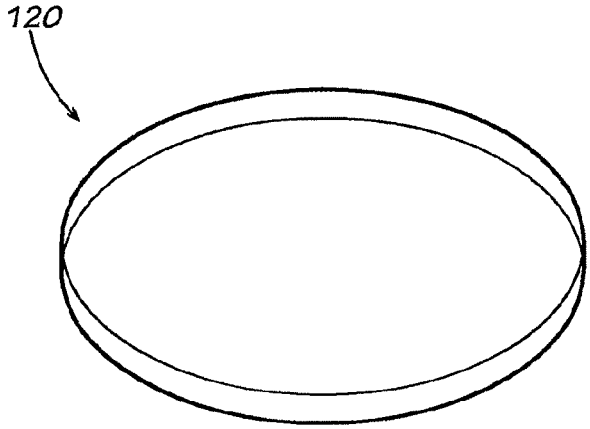
FIG. 5 is a top perspective view of a specular inner ring or lining configured to be disposed within a reflector according to an embodiment of the present invention.

With reference to FIGS. 1-4, in some embodiments, the at least one reflector cavity 110 comprises a plurality of reflector cavities, such as in a semi toroidal reflector 100. Moreover, in some embodiments, a semi toroidal reflector 100 can further comprise a specular inner ring 120 as illustrated in FIG. 5. A specular inner ring 120 in some embodiments is positioned along the rim 102 of the semi toroidal reflector 100, as shown in FIG. 4.

Figure 6:
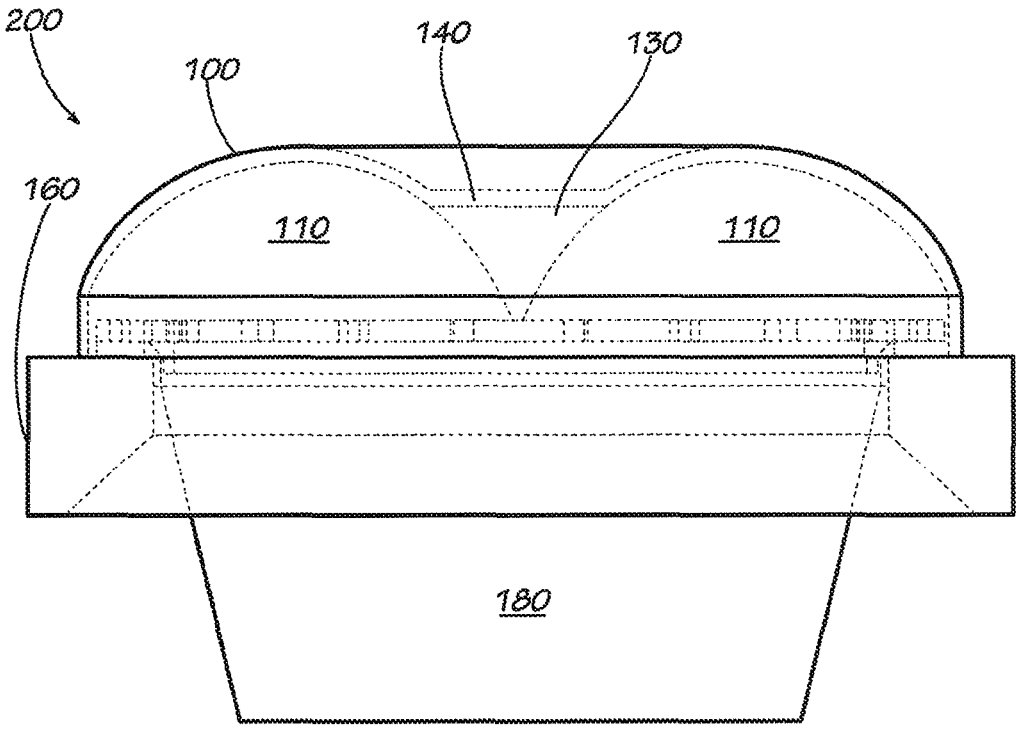
FIG. 6 is a side elevation view of a luminaire according to one embodiment of the present invention wherein inner edges are shown with dotted lines.
Figure 7:
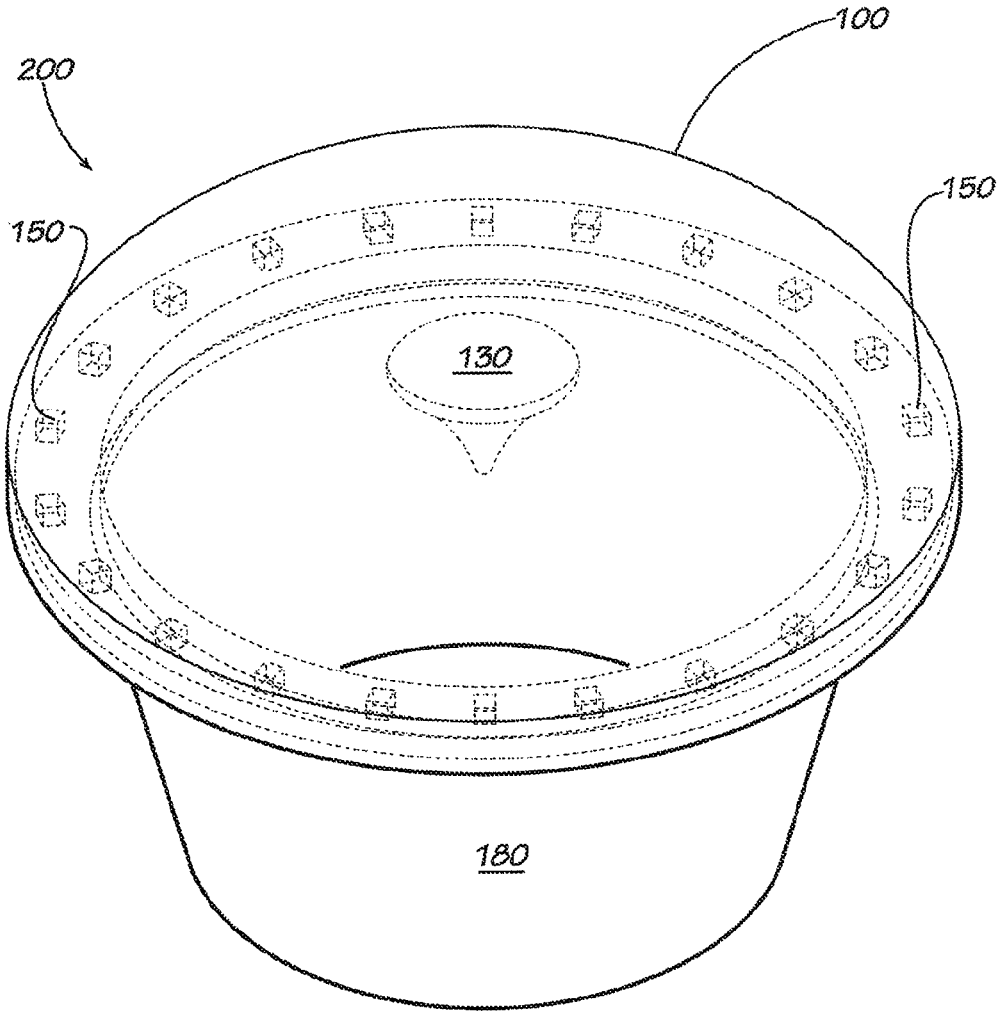
FIG. 7 is a top perspective view of a luminaire according to an embodiment of the present invention wherein inner edges are shown with dotted lines.

With reference to FIGS. 6 and 7, in some embodiments, the optical element 130 of a luminaire 200 is at least partially disposed in the at least one reflector cavity 110. In some embodiments, an optical element 130 is centered in the reflector cavity 110. In some embodiments, an optical element 130 is coupled to a surface 140 of the at least one reflector cavity 110.

In some embodiments, an optical element 130 is removably coupled to the surface 140 of the at least one reflector cavity 110, thereby permitting interchangeability with other optical elements to create different light distributions, surface effects and/or color. The size and shape of the optical element 130, in some embodiments, can vary to create different sized distributions and output larger or smaller candle power distributions. The optical element 130, in some embodiments, can protrude outside the reflector cavity 110 to widen the light distribution above 180 degrees.

As described herein, an optical element 130 is operable to receive light reflected from the at least one reflector cavity 110 and reflect and/or refract the received light out of the luminaire 200. In reflecting and/or refracting light received from one or more reflector cavities 110, the optical element 130 can tailor the light distribution of the luminaire 200. Moreover, as the optical element 130 does not block light as a mask does in prior luminaires that utilize constructive occlusion, the optical element 130 increases lighting efficiencies. In some embodiments, luminaires described herein have an efficiency of at least 60% or at least 65%. In some embodiments, luminaires have an efficiency of at least 70% or at least 80%.

Figure 8:
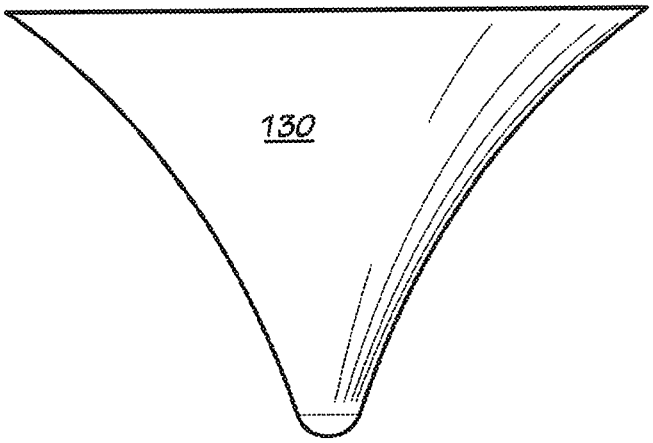
FIG. 8 is a side elevation view of an optical element of a luminaire according to one embodiment of the present invention.
Figure 8A:
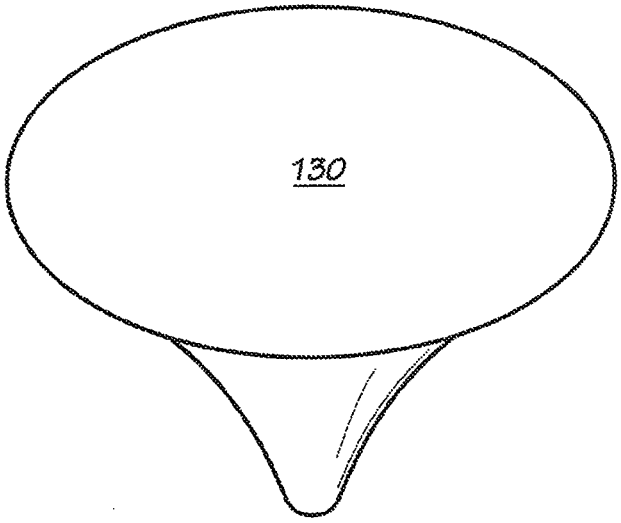
FIG. 8A is a top perspective view of an optical element of a luminaire according to the embodiment of FIG. 8.
Figure 9:
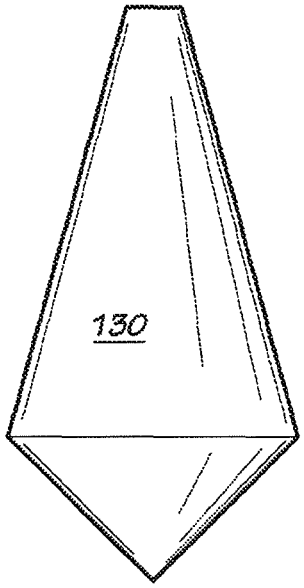
FIG. 9 is a side elevation view of an optical element of a luminaire according to one embodiment of the present invention.
Figure 9A:
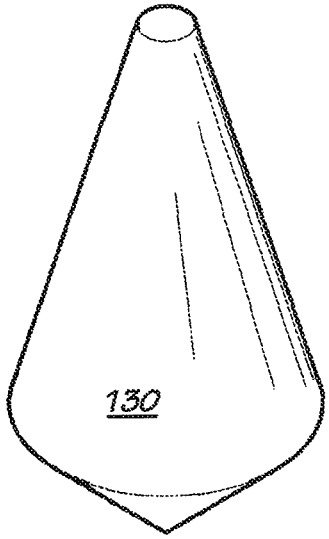
FIG. 9A is a top perspective view of an optical element of a luminaire according to the embodiment of FIG. 9.
Figure 10:
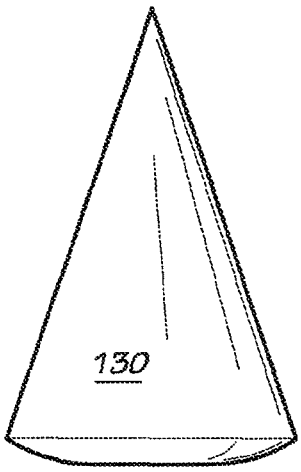
FIG. 10 is a side elevation view of an optical element of a luminaire according to one embodiment of the present invention.
Figure 10A:
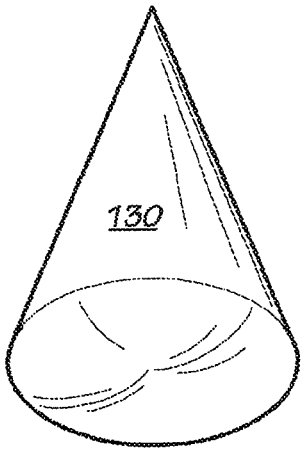
FIG. 10A is a bottom perspective view of an optical element of a luminaire according to the embodiment of FIG. 10.
Figure 11:
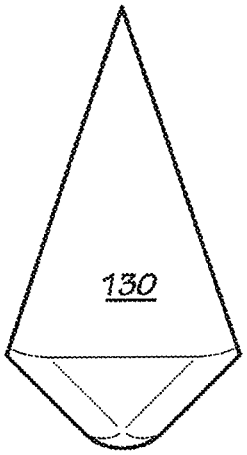
FIG. 11 is a side elevation view of an optical element of a luminaire according to one embodiment of the present invention.
Figure 11A:
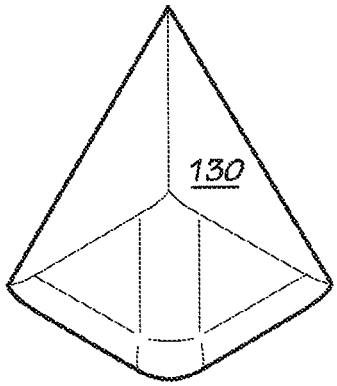
FIG. 11A is a bottom perspective view of an optical element of a luminaire according to the embodiment of FIG. 11.
Figure 12:
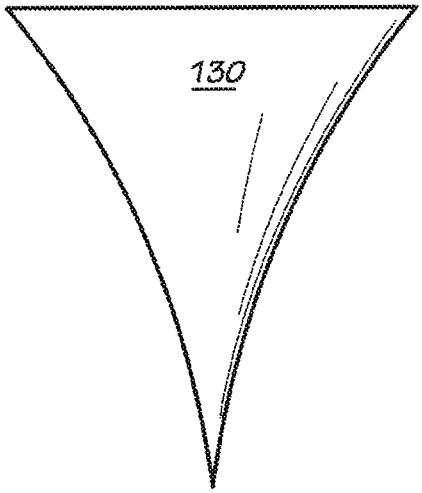
FIG. 12 is a side elevation view of an optical element of a luminaire according to one embodiment of the present invention.
Figure 12A:
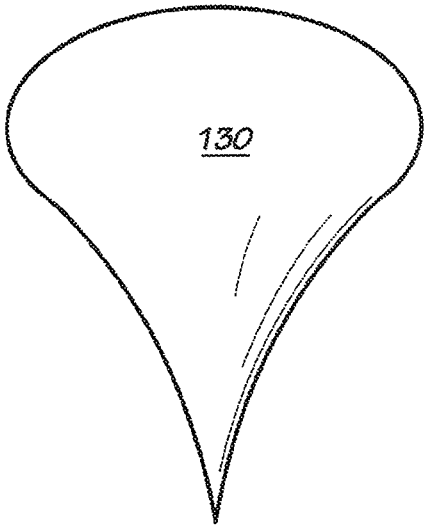
FIG. 12A is a bottom perspective view of an optical element of a luminaire according to the embodiment of FIG. 12.
Figure 13:
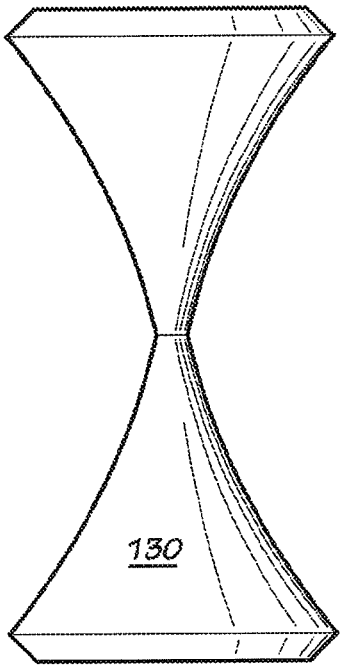
FIG. 13 is a side elevation view of an optical element of a luminaire according to one embodiment of the present invention.
Figure 13A:
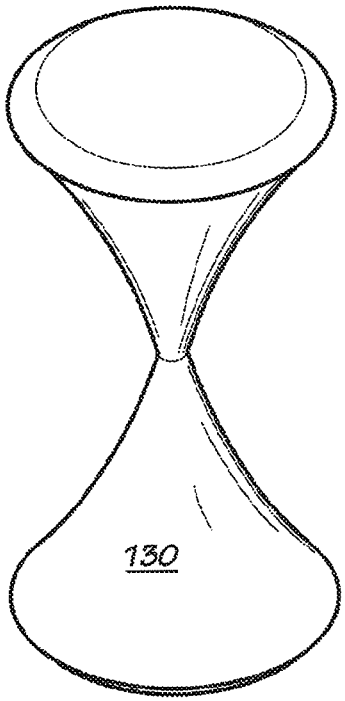
FIG. 13A is a top perspective view of an optical element of a luminaire according to the embodiment of FIG. 13.
Figure 14:
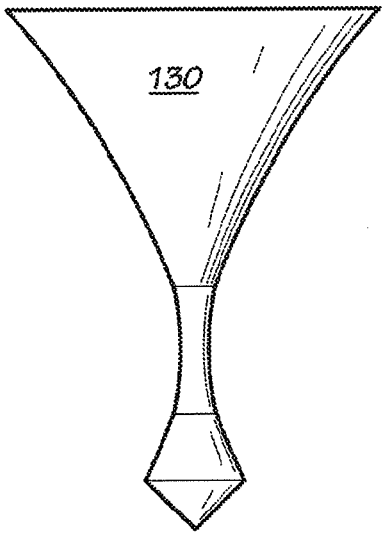
FIG. 14 is a side elevation view of an optical element of a luminaire according to one embodiment of the present invention.
Figure 14A:
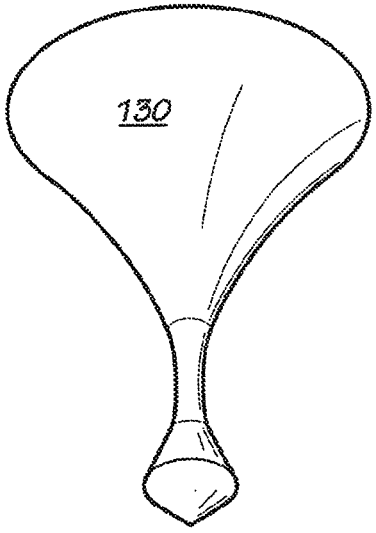
FIG. 14A is a bottom perspective view of an optical element of a luminaire according to the embodiment of FIG. 14.

An optical element 130 can have any desired shape not inconsistent with the objectives of the present invention. FIGS. 8-14A illustrate various non-limiting shapes of optical elements 130 according to some embodiments of the present invention. In particular, the optical element may be a conical shape with a tapered side and smooth distal tip (FIGS. 8 and 8A), a dual-conical shape (FIGS. 9 and 9A), a conical shape with a rounded base (FIGS. 10 and 10A), a dual-pyramidal shape (FIGS. 11 and 11A), a conical shape with a tapered side and pointed distal tip (FIGS. 12 and 12A), an hourglass shape (FIGS. 13 and 13A) or a modified hourglass shape (FIGS. 14 and 14A). Additionally, an optical element 130 can be made from any material not inconsistent with the objectives of the present invention. In some embodiments, an optical element 130 comprises a metal, polymeric material or glass. In some embodiments, an optical element 130 is overcoated with one or more materials. An optical element 130, in some embodiments, is finished with one or more treatments such as specular, semi-specular or textured features. In some embodiments, an optical element 130 is painted one or more colors or infused with a color. In other embodiments, an optical element 130 is colorless or radiation transmissive.

More specifically, at least a portion (or the entirety) of the optical element 130 and/or surface 140 of reflector cavity 110 may have extremely high surface reflectivity, preferably, but not necessarily, between 96%-99.5%, inclusive and more preferably 98.5-99%. To achieve the desired reflectivity, in one embodiment the optical element 130 and/or surface 140 of reflector cavity 110 is coated with a diffuse, reflective material, including, but not limited to, reflective paints. Alternatively, the optical element 130 and/or surface 140 of reflector cavity 110 could include a layer of a reflective flexible sheet of material such as one or more of the materials sold under the tradenames GL-22, GL-80, GL-30 or Optilon™, all available from DuPont. Alternative materials include Miro® reflective aluminum materials, available from Alanod, and micro cellular polyethylene ("MCPET"), available from Furukawa. Specular materials would also be suitable. The reflective material may be substantially glossy or substantially flat. In one example, the reflective material is preferably matte white to diffusely reflect incident light. Other embodiments may utilize textured or colored paints or impart a baffled shape to the interior optical element 130 and/or surface 140 of reflector cavity 110 to obtain a desired reflection. Alternatively, the optical element 130 and/or surface 140 of reflector cavity 110 can be formed from a reflective material so that the surface of the optical element 130 and/or surface 140 of reflector cavity 110 need not be separately treated to attain the desired reflectivity.

It will be recognized that some light may, but need not necessarily, reflect directly off the surface 140 of reflector cavity 110 and exit the luminaire 200 without first reflecting off the optical element 130.

Figure 15:
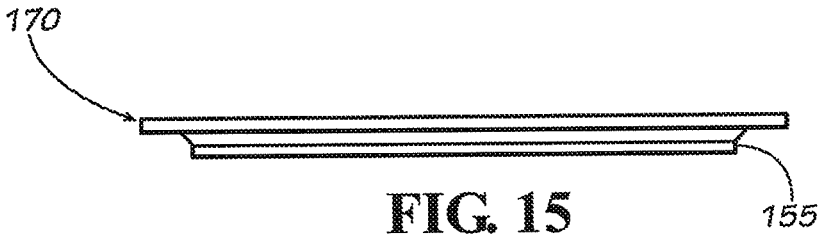
FIG. 15 is a side elevation view of a light-emitting diode (LED) mask for an annular arrangement of LED light sources of a luminaire according to one embodiment of the present invention.
Figure 16:
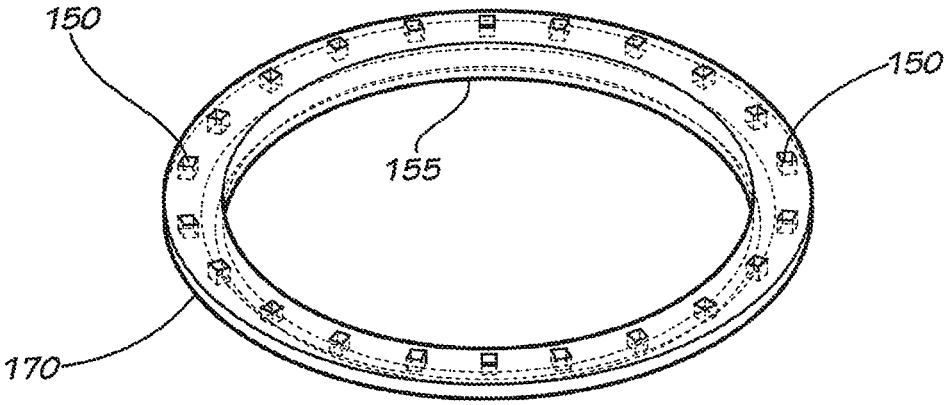
FIG. 16 is a top perspective view of an annular arrangement of LED light sources of a luminaire wherein inner edges are shown with dotted lines.
Figure 18:
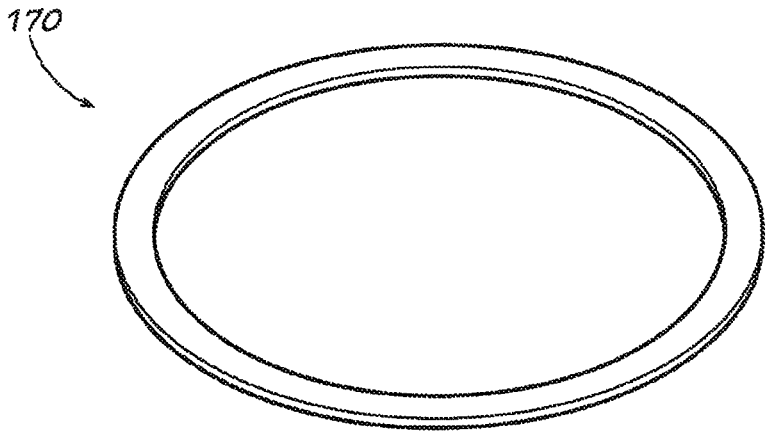
FIG. 18 is a top perspective view of a circuit board for an annular arrangement of LED light sources of a luminaire according to an embodiment of the present invention.

In some embodiments, a light source for a luminaire described herein comprises one or more LEDs 150. In some embodiments, a plurality of LEDs 150 are arranged on a printed circuit board 170 (see FIG. 18) in an annular arrangement as illustrated in FIGS. 15 and 16. The printed circuit board 170 may include a beveled portion 155 that partially extends into the reflector cavity 110 when the printed circuit board 170 is installed in the luminaire so that direct light from the plurality of LEDs 150 is not visible from outside the luminaire 200.

Figure 17:
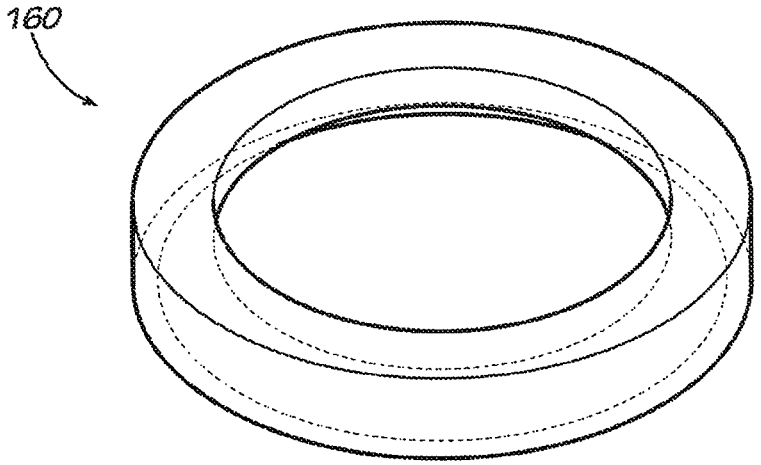
FIG. 17 is a top perspective view of a heat sink for an annular arrangement of LED light sources of a luminaire according to one embodiment of the present invention wherein inner edges are shown with dotted lines.

In one embodiment a heat sink 160 (see FIG. 17) is attached to the luminaire, as illustrated in FIG. 6. The heat sink 160 may be provided for thermal management of heat generated by the plurality of LEDs 150. As shown in FIG. 6, the heat sink is directly attached to the luminaire 200 for conductive removal of heat from the plurality of LEDs 150. Convective removal of heat from the plurality of LEDs 150 may be achieved by circulation of air within the reflector cavity 110 of the luminaire 200.

Figure 19:
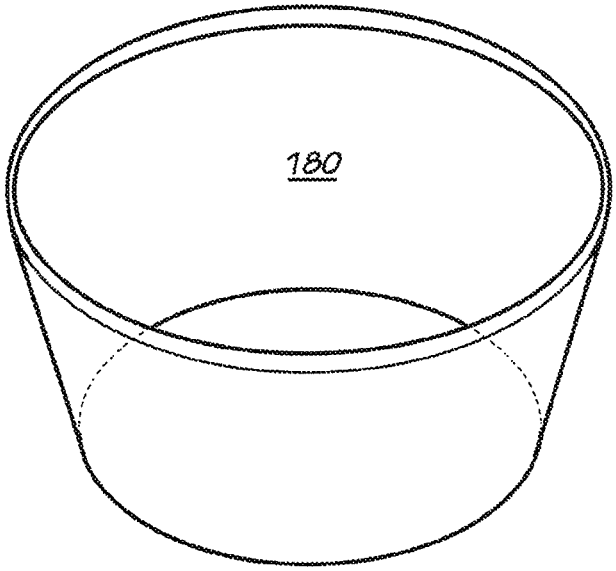
FIG. 19 is a top perspective view of an occlusion shield of a luminaire according to one embodiment of the present invention wherein inner edges are shown with dotted lines.

In some embodiments, a luminaire 200 described herein further comprises an occlusion shield 180. An occlusion shield 180, in some embodiments, can widen or narrow the distribution of light out of the luminaire 200. As the occlusion shield 180 is cylindrical and hollow. In some embodiments, the occlusion shield 180 does not function as a mask in traditional constructively occluded architectures. FIG. 19 illustrates an occlusion shield 180 according to one embodiment of the present invention.

With reference to FIGS. 6 and 7, an exemplary assembly of a luminaire 200 according to the present invention will now be described. The luminaire includes a reflector 100 having a reflector cavity 110. An optical element 130 is removably attached to a surface 140 of the reflector 100. A specular inner ring 120 may be positioned along the rim 102 of the reflector 100 (see FIG. 4). An annular-shaped printed circuit board 170 having mounted thereon a plurality of LEDs 150 may be attached to the reflector 100 within the reflector cavity 110. A heat sink 160 may be attached to the luminaire 200 to facilitate removal of heat generated by the plurality of LEDs 150. An occlusion shield 180 may be installed along the inside perimeter of the reflector 100 to widen or narrow the distribution of light out of the luminaire 200.

In another aspect, the present invention provides methods of lighting a surface. In some embodiments, a method of lighting a surface comprises providing a luminaire 200 comprising at least one light source, at least one reflector 100 having a reflector cavity 110 and an optical element 130 positioned to receive light reflected from the at least one reflector cavity 110, wherein the luminaire 200 does not comprise a mask at least partially occluding the aperture of the at least one reflector cavity 110, reflecting light from the light source off the at least one reflector cavity 110 to the optical element 130 and reflecting or refracting the light received from the at least one reflector cavity 110 out of the luminaire.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

We claim:

1. A luminaire comprising:

a reflector comprising an inner surface defining at least one reflector cavity;

a plurality of light emitting diodes positioned within the luminaire to direct light into the at least one reflector cavity; and an optical element at least partially positioned within the reflector cavity to receive light reflected from the at least one reflector cavity, wherein the optical element is positioned within the reflector cavity such that light received on the optical element from the reflector cavity exits the luminaire unimpeded.

2. The luminaire according to claim 1, wherein the inner surface of the reflector is semi toroidal.

3. The luminaire according to claim 1, wherein the optical element is centered, and extends downwardly, within the reflector cavity.

4. The luminaire according to claim 1, wherein the optical element is coupled to the inner surface.

5. The luminaire according to claim 1, wherein the optical element is removably coupled to the inner surface.

6. The luminaire according to claim 1, wherein the optical element is entirely positioned within the at least one reflector cavity.

7. The luminaire according to claim 1, wherein the optical element protrudes outside the reflector cavity.

8. The luminaire according to claim 1, wherein the optical element comprises a metal, polymeric material or glass.

9. The luminaire according to claim 1, wherein the optical element is substantially conical.

10. The luminaire according to claim 1, wherein the plurality of light emitting diodes are oriented in a substantially annular array.

11. The luminaire according to claim 1, wherein the luminaire further comprises one or more of a specular inner ring, a heat sink, an occlusion shield, and combinations thereof.

12. The luminaire according to claim 11, wherein the occlusion shield is configured to widen or narrow the distribution of light exiting the luminaire.

13. The luminaire according to claim 1, wherein the optical element is located at a center of the reflector cavity and the plurality of light emitting diodes are positioned around an inside perimeter of the luminaire to direct light towards the reflector cavity and the optical element located at the center of the reflector cavity.

14. A method for lighting a surface, comprising:

providing a luminaire comprising a reflector comprising an inner surface defining at least one reflector cavity;

a plurality of light emitting diodes positioned within the luminaire to direct light into the at least one reflector cavity; and an optical element at least partially positioned within the reflector cavity to receive light reflected from the at least one reflector cavity, and directing light from the plurality of light emitting diodes onto the reflector cavity such that the light reflects from the reflector cavity onto the optical element and exits the luminaire unimpeded onto the surface.

15. The method according to claim 14, wherein the reflector cavity is semi toroidal.

16. The method according to claim 14, wherein the method further comprises removing the optical element from the luminaire and replacing it with a different optical element.

17. The method according to claim 14, wherein the optical element is located at a center of the reflector cavity and the plurality of light emitting diodes are positioned around an inside perimeter of the luminaire to direct light towards the reflector cavity and the optical element located at the center of the reflector cavity.

* * * * *